United States Patent [19]

Scheller et al.

[11] 4,168,936

[45] Sep. 25, 1979

[54] STUFFING BOX

[75] Inventors: Klaus Scheller, Neumarkt; Adolf Kratzer, Nüremberg, both of Fed. Rep. of Germany

[73] Assignee: Klein, Schanzlin & Becker Aktiengesellschaft, Frankenthal, Fed. Rep. of Germany

[21] Appl. No.: 839,326

[22] Filed: Oct. 4, 1977

[30] Foreign Application Priority Data

Oct. 9, 1976 [DE] Fed. Rep. of Germany ..... 2645755

[51] Int. Cl.[2] ..... F04D 29/10

[52] U.S. Cl. ..... 415/170 A; 277/103; 277/27

[58] Field of Search ..... 415/110, 111, 112, 113, 415/169 R, 170 R, 170 A, 174; 277/27, 103, 113

[56] References Cited

U.S. PATENT DOCUMENTS

| | | | |
|---|---|---|---|
| 512,551 | 1/1894 | Kelly | 277/103 |
| 1,990,519 | 2/1935 | Bigelow et al. | 415/112 |
| 2,190,670 | 2/1940 | Mann | 415/113 |
| 2,957,712 | 10/1960 | Farmer | 277/103 |
| 3,434,728 | 3/1969 | Soldato | 277/103 |

*Primary Examiner*—Louis J. Casaregola
*Attorney, Agent, or Firm*—Peter K. Kontler

[57] ABSTRACT

A stuffing box which prevents the escape of highly pressurized, hot, solids-containing and/or toxic fluid media from the housing of a centrifugal pump has a receptacle with a flange which is sealingly secured to the housing and with a cylindrical portion spacedly surrounding that part of the pump shaft which extends from the housing. The receptacle contains a ring-shaped stop which is adjacent to the housing and surrounds the shaft, one or more deformable annular packings surrounding the shaft adjacent the stop, a reciprocable annular gland adjacent to the packings opposite the stop, and a sealing ring which engages the receptacle and the shaft and defines with the gland a plenum chamber for a sealing fluid. The pressure of sealing fluid exceeds the pressure of fluid medium in the pump housing, and the sealing fluid biases the gland against the packings so that the packings expand and sealingly engage the shaft and the internal surface of the cylindrical portion of the receptacle.

9 Claims, 1 Drawing Figure

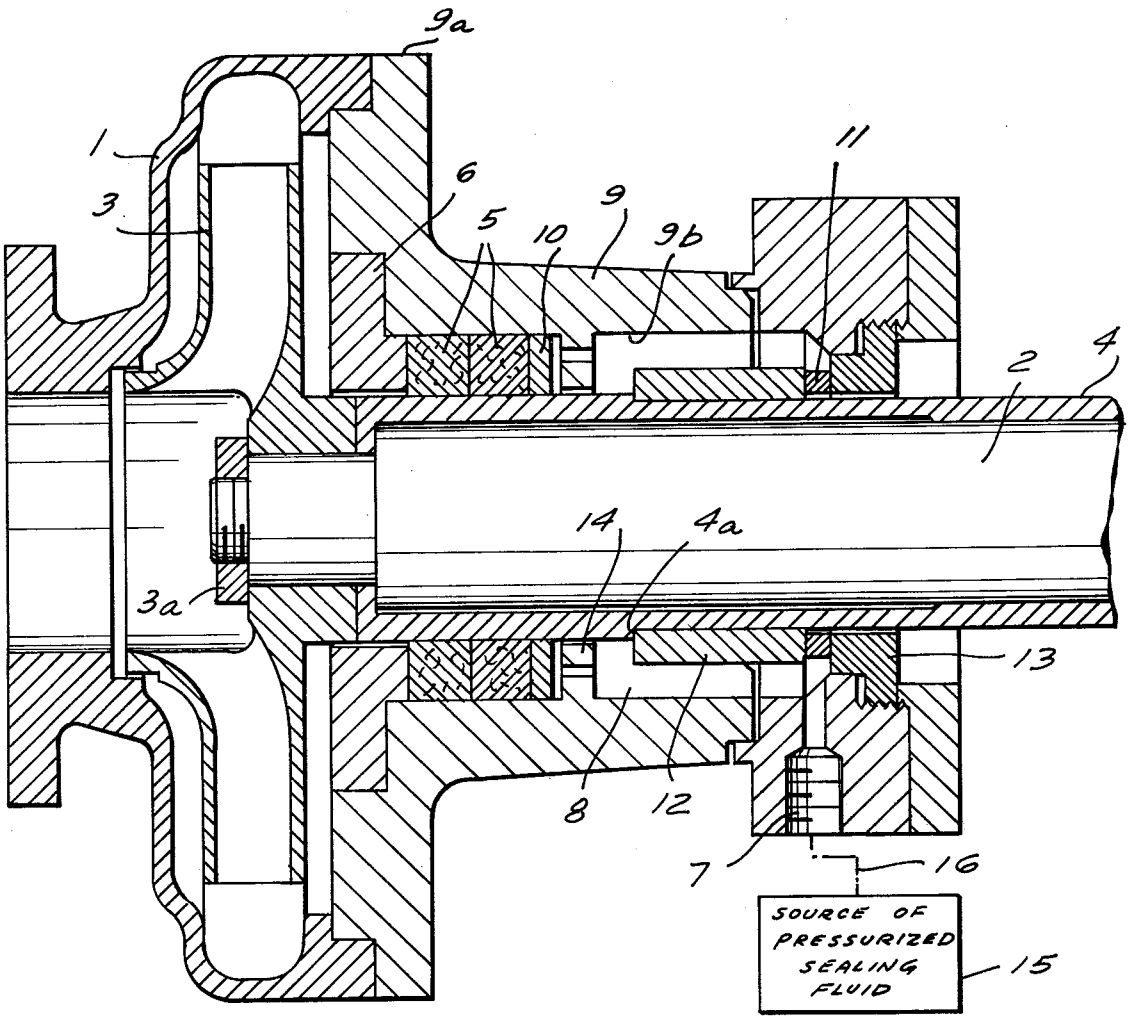
SOURCE OF PRESSURIZED SEALING FLUID
1
2
3
3a
4
4a
5
6
7
8
9
9a
9b
10
11
12
13
14
15
16

STUFFING BOX

BACKGROUND OF THE INVENTION

The present invention relates to pumps, valves and analogous fluid conveying or fluid flow controlling devices, and more particularly to improvements in stuffing boxes which can be used in or in combination with such devices to prevent the leakage of conveyed fluid media along the peripheral surfaces of rotary and/or reciprocating members. Still more particularly, the invention relates to improvements in stuffing boxes which are especially suited to prevent leakage of fluid media between the body or housing and the rotating shaft (movable member) of a centrifugal pump, for example, a centrifugal pump which is designed to convey fluid media at elevated temperatures, media which contain solid particles, media which are subjected to a very pronounced pressurizing action and/or media which contain toxic or other deleterious ingredients.

The shaft seal of a pump for circulation of a hot fluid medium which is maintained at an elevated pressure and/or contains toxic or other deleterious ingredients as well as solid particles must be designed with a view to positively prevent leakage of any, or to positively prevent leakage of appreciable quantities of, the fluid medium which passes through the pump housing. Heretofore known shaft seals (primarily stuffing boxes) are incapable of satisfying all of the above requirements, i.e., if the stuffing box can stand elevated pressures and/or temperatures, it cannot withstand the corrosive action of solids which are dispersed in the fluid and/or the action of other constituents including acids or the like. For example, water or another liquid which is used for the scrubbing of gases often contains several aggressive ingredients as well as tar which presents additional problems.

When the gland of the stuffing box is biased against the packing by a pressurized sealing fluid other than the fluid medium which is circulated in the housing of a centrifugal pump, the pressure of sealing fluid must exceed the pressure of fluid medium in the pump housing; therefore, the highly pressurized sealing fluid exhibits a strong tendency to escape into the surrounding atmosphere. The rate at which the sealing fluid leaks increases as the wear upon the sealing means for preventing or reducing such leakage increases. Therefore, presently known stuffing boxes which operate with sealing fluid must be equipped with complex, bulky and expensive auxiliary components which insure that the pressure of sealing fluid does not drop below the pressure of fluid medium in the pump housing in spite of progressively increasing leakage of sealing fluid into the surrounding atmosphere. In the absence of such auxiliary equipment, the pressure of sealing fluid rapidly drops below the pressure in the interior of the pump housing so that the conveyed medium penetrates into the stuffing box and mixes with the sealing fluid. Consequently, the sealing fluid which escapes from the stuffing box contains at least traces of the conveyed fluid medium which is especially undesirable when the fluid medium is very hot and/or contains toxic or other deleterious ingredients.

Attempts to prevent excessive leakage of sealing fluid from the stuffing box include the provision of double-acting friction seals. A double-acting friction seal is likely to control the leakage of sealing fluid for a certain interval of time; however its useful life is short, especially if the pressure of sealing fluid is relatively high (i.e., higher than the pressure in the interior of the pump housing). In order to insure relatively long useful life of a double-acting friction seal, it is necessary to assemble such seal from components which are made of expensive material. Moreover, the nature of the sealing fluid cannot be selected at will, i.e., the sealing fluid should not attack the constituents of the double-acting seal. All in all, the cost of a stuffing box which employs a pressurized sealing fluid and one or more double-acting friction seals is extremely high which is particularly undesirable because the useful life of seals for the sealing fluid is rather short, even if such seals are made of an expensive material and are machined or otherwise shaped with a high degree of precision.

A double-acting friction seal is especially affected by highly viscous constituents of the fluid medium in the pump body. For example, if the fluid medium contains tar which escapes into the stuffing box and is admixed to the sealing fluid, and if the viscosity of tar increases in response to cooling of the sealing fluid, the hardened tar prevents slippage of the constituents of a double-acting friction seal with respect to the shaft of a pump or with respect to a rotary element of a valve.

Another serious drawback of double-acting friction seals is that, when the pressure of sealing fluid drops (i.e., as a result of malfunction of the apparatus which pressurizes the sealing fluid), the double-acting seal cannot prevent immediate penetration of the fluid medium from the pump housing into the stuffing box.

OBJECTS AND SUMMARY OF THE INVENTION

An object of the invention is to provide a stuffing box which can prevent the escape of hot, highly pressurized, solids-containing and/or toxic fluid media from a pump, valve or another fluid confining and/or circulating device with a higher degree of reliability than heretofore known stuffing boxes.

Another object of the invention is to provide a stuffing box wherein at least the majority of sensitive components are shielded from contact with aggressive fluid media whose escape is to be prevented or held to a minimum.

A further object of the invention is to provide a novel and improved stuffing box of the type wherein the gland is biased against one or more deformable packings by a pressurized sealing fluid, e.g. that fluid which is used to cool a centrifugal pump or the like.

An additional object of the invention is to provide a stuffing box which can be installed in existing pumps or analogous fluid media confining and/or circulating devices as a simpler, longer-lasting and less expensive substitute for heretofore known stuffing boxes.

An ancillary object of the invention is to provide novel and improved means for preventing escape of sealing fluid from a stuffing box of the type wherein the gland is biased against the packing or packings by a hydraulic or pneumatic sealing fluid.

Another object of the invention is to provide a novel and improved receptacle for use in a stuffing box of the above outlined character.

The invention is embodied in a stuffing box, particularly in a stuffing box for establishing a fluidtight seal between the housing or body and a shaft or another movable member of a device (e.g., a centrifugal pump) wherein a portion of the movable member extends from the housing and the latter contains a highly pressurized, hot, solids-containing and/or toxic fluid medium. The improved stuffing box comprises a receptacle having an internal surface spacedly surrounding the aforementioned portion of the movable member and a flange or a similarly configurated end portion which is sealingly secured to the housing, at least one deformable annular packing located in the receptacle and surrounding the portion of the movable member, stop means provided in the receptacle between the packing and the housing, an annular gland reciprocably received in the receptacle and being adjacent the packing opposite the stop means, and an annular sealing element engaging the portion of the movable member and the receptacle. The sealing element, the gland, the receptacle and the portion of the movable member define a preferably annular fluid-filled plenum chamber so that the fluid which fills the chamber urges the gland into deforming engagement with the packing which bears against the stop means and expands into sealing engagement with the internal surface of the receptacle as well as with the peripheral surface of the movable member. The plenum chamber is preferably connected to a source of sealing fluid wherein the pressure of sealing fluid exceeds the pressure of flowable medium in the housing.

In accordance with a presently preferred embodiment of the stuffing box, one end face of the annular sealing element sealingly contacts an end face of the aforementioned portion of the movable member and the other end face of the sealing element is in sealing contact with an adjustable nut or another component of the receptacle. The receptacle may comprise a plurality of separable portions one of which biases the sealing element against the aforementioned portion of the movable member.

The novel features which are considered as characteristic of the invention are set forth in particular in the appended claims. The improved stuffing box itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a fragmentary axial sectional view of a centrifugal pump and an axial sectional view of a stuffing box which embodies one form of the invention and serves to prevent escape of fluid medium from the pump housing along the outwardly extending portion of the pump shaft.

DESCRIPTION OF THE PREFERRED EMBODIMENTS

The drawing shows a portion of a centrifugal pump which comprises a housing or body 1, a drive shaft 2 which extends from the housing 1 and is surrounded by a protective sleeve 4, and an impeller 3 which is secured to the left-hand end portion of the shaft 2 (i.e., to that end portion which is located in the interior of the housing 1) by a nut 3*a*. The manner in which the flowable medium to be conveyed is admitted into and evacuated from the pump housing 1 forms no part of the invention. The sleeve 4 rotates with and can be said to form part of the shaft 2.

That portion of the sleeve 4 which extends from the housing 1 is spacedly surrounded by a receptacle 9 having an outwardly extending annular flange 9*a* which is sealingly secured to the housing 1 in a manner not forming part of the invention. The internal surface 9*b* of the cylindrical portion of the receptacle 9 spacedly surrounds the sleeve 4 and may but need not have a constant diameter. The receptacle 9 forms part of the improved stuffing box or shaft seal, and the latter further comprises a ring-shaped stop 6 which can be said to form part of the receptacle 9 and is adjacent to the housing 1, one of more deformable annular stuffing box packings 5 which are outwardly adjacent to the stop 6, a ring-shaped gland 10 which can be said to constitute a piston and is adjacent to the right-hand side of the right-hand packing 5, and a ring-shaped sealing element 11 which sealingly engages the shaft 2 as well as the receptacle 9. As shown, the sleeve 4 has an external shoulder 4*a* which constitutes an abutment for one end face of a cylindrical collar 12. The other end face of the collar 12 abuts against the sealing element 11. The latter is biased against the collar 12 (which rotates with and thus forms part of the shaft 2) by a nut 13 which meshes with the receptacle 9. The nut can be said to constitute a component of the receptacle 9. Thus, the left-hand end face of the sealing element 11 is in sealing contact with (the nut 13 of) the receptacle 9 and the left-hand end face of the sealing element 11 is in sealing contact with (the collar 12 of) the shaft 2. The sleeve 4 (and its collar 12), the receptacle 9, the sealing element 11 and the gland 10 define an annular plenum chamber 8 which is filled with a sealing fluid whose pressure preferably exceeds the pressure of flowable medium in the housing 1. The receptacle 9 may comprise a flow restrictor 14 which extends into the chamber 8 between the collar 12 and gland 10 to throttle the flow of sealing fluid toward the right-hand end face of the gland. The sealing fluid is stored in a source of supply 15 which is connected to the receptacle 9 by a conduit 16 communicating with the chamber 8 by way of a fluid-admitting port 7 in the receptacle 9. The pressure of fluid in the source 15 can be regulated in a manner known per se to insure that the pressure of fluid in the chamber 8 exceeds the pressure of flowable medium in the housing 1 even in the event of some or pronounced leakage of sealing fluid from the chamber 8.

Some sealing fluid will normally flow between the internal surface of the gland 10 and the periphery of the sleeve 4 to penetrate between the periphery of the sleeve and one or both packings 5. Such fluid positively prevents leakage of flowable medium from the housing 1. Pressurized sealing fluid in the chamber 8 biases the gland 10 into deforming engagement with the adjacent packing 5, i.e., the packings 5 expand into sealing engagement with the internal surface 9*b* of the cylindrical portion of the receptacle 9 as well as with the periphery of the sleeve 4. At the same time, the gland 10 biases the left-hand packing 5 against the stop 6.

The sealing element 11 prevents escape of sealing fluid from the plenum chamber 8 into the surrounding atmosphere.

The quantity of sealing fluid in the plenum chamber 8 determines the force with which the packings 5 bear against the stop 6, internal surface 9*b* of the cylindrical portion of the receptacle 9 and the periphery of the sleeve 4. Thus, the quantity of the sealing fluid in the chamber 8 will be selected as a function of the desired pressure of packings 5 against the shaft 2 and receptacle 9. The force with which the gland 10 bears against the adjacent packing 5 depends on the selected pressure of sealing fluid, on the selected dimensions of the packings 5 and on the selected dimensions of the gland 10. By appropriate selection of these parameters, the improved stuffing box can maintain the pressure of sealing fluid in the chamber 8 within a very narrow range for extended periods of time.

The just described stuffing box exhibits a number of important advantages over the conventional stuffing boxes. For example, when the pressure of sealing fluid in the chamber 8 drops below an optimum value, the improved stuffing box is still capable of preventing escape of flowable medium from the housing 1 for a surprisingly long interval of time. This renders it possible to eliminate the cause of malfunction (i.e., impurities in the connection between the source 15 and the chamber 8) before the flowable medium can penetrate into the chamber 8. If the chamber 8 is contaminated with impurities, the stuffing box can be rinsed in any suitable way and is then ready for renewed use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and therefore, such adaptations should and are intended to be comprehended within the meaning and range of equivalence of the claims.

We claim:

1. A stuffing box, particularly for establishing a fluid-tight seal between the housing and a movable member of a device wherein a portion of the movable member extends from the housing and the housing contains a highly pressurized, hot, solids-containing and/or toxic fluid medium, comprising a receptacle having an internal surface spacedly surrounding said portion of the movable member, said receptacle including an end portion sealingly secured to the housing; at least one deformable annular packing located in said receptacle and surrounding said portion of the movable member; stop means provided in said receptacle between said packing and the housing; an annular gland reciprocably received in said receptacle and adjacent to said packing opposite said stop means; an annular sealing element sealingly engaging said portion of the movable member and said receptacle, said element defining with said gland, with said receptacle and with said portion of the movable member a fluid-filled plenum chamber so that the fluid filling said chamber urges said gland into deforming engagement with said packing so that the packing bears against said internal surface and said portion of the movable member and the fluid in said plenum chamber contacts said portion of the movable member; a source of sealing fluid whose pressure exceeds the pressure of medium in the housing; and means for connecting said source with said chamber.

2. A stuffing box as defined in claim 1, wherein said sealing element has first and second end faces, said portion of the movable member being in sealing contact with one of said end faces and said receptacle having a portion in sealing contact with the other end face of said element.

3. A stuffing box as defined in claim 1, wherein said gland is received in said receptacle with at least some clearance to permit some fluid to flow from said chamber into contact with said packing.

4. A stuffing box as defined in claim 1, further comprising flow restrictor means disposed in said chamber between said sealing element and said gland.

5. A stuffing box as defined in claim 1, wherein said stop means includes a ring rigid with said end portion of said receptacle.

6. A stuffing box as defined in claim 1, wherein said receptacle includes a cylindrical portion which defines said internal surface and a flange which is rigid with the housing and constitutes said end portion.

7. A stuffing box as defined in claim 1, wherein said device is a centrifugal pump and said member is a rotary shaft a protective sleeve of which is surrounded by said receptacle, by said stop means, by said packing, by said gland, by said chamber and by said sealing element.

8. A stuffing box as defined in claim 1, wherein said receptacle comprises means for biasing said sealing element against said portion of the movable member.

9. A stuffing box as defined in claim 1, wherein said receptacle comprises a plurality of separable portions.

* * * * *